US007950443B2

(12) United States Patent
Rasset et al.

(10) Patent No.: US 7,950,443 B2
(45) Date of Patent: May 31, 2011

(54) APPARATUS FOR TILTING AND SECURING A HEAT EXCHANGER

(75) Inventors: John T. Rasset, Barnesville, MN (US); Jay M. Larson, Kindred, ND (US)

(73) Assignee: CNH America LLC, New Holland, PA (US)

( * ) Notice: Subject to any disclaimer, the term of this patent is extended or adjusted under 35 U.S.C. 154(b) by 293 days.

(21) Appl. No.: 12/098,931

(22) Filed: Apr. 7, 2008

(65) Prior Publication Data

US 2008/0185124 A1 Aug. 7, 2008

Related U.S. Application Data

(62) Division of application No. 10/877,379, filed on Jun. 25, 2004, now Pat. No. 7,370,690.

(51) Int. Cl.
*B60K 11/04* (2006.01)
*F01P 11/08* (2006.01)

(52) U.S. Cl. ..... 165/41; 165/77; 165/86; 165/95; 165/140; 165/67; 180/68.4; 248/232; 49/261; 292/268; 292/269

(58) Field of Classification Search ..... 165/41, 165/77, 86, 95, 140, 67; 180/68.4; 248/232, 248/233, 234; 49/261, 356; 292/265, 268, 292/269

See application file for complete search history.

(56) References Cited

U.S. PATENT DOCUMENTS

| | | | | |
|---|---|---|---|---|
| 2,175,861 | A * | 10/1939 | Wall | 49/261 |
| 3,297,080 | A | 1/1967 | Williams et al. | |
| 3,334,704 | A | 8/1967 | Gehrke et al. | |
| 4,066,119 | A | 1/1978 | Stedman | |
| 4,542,785 | A | 9/1985 | Bagnall et al. | |
| 4,696,361 | A | 9/1987 | Clark et al. | |
| 5,219,016 | A | 6/1993 | Bolton et al. | |
| 6,024,164 | A * | 2/2000 | Sorbel | 165/41 |
| 6,092,616 | A | 7/2000 | Burris et al. | |
| 6,105,660 | A | 8/2000 | Knurr | |
| 6,318,450 | B1 | 11/2001 | Acre | |
| 6,381,139 | B1 * | 4/2002 | Sun | 361/725 |
| 6,470,961 | B1 | 10/2002 | Case | |
| 6,648,088 | B2 | 11/2003 | Gabioli | |
| 6,966,355 | B2 * | 11/2005 | Branham et al. | 165/41 |
| 7,370,690 | B2 * | 5/2008 | Rasset et al. | 165/41 |
| 2003/0047656 | A1 | 3/2003 | Neufang | |

FOREIGN PATENT DOCUMENTS

| | | | |
|---|---|---|---|
| GB | 2332507 | A * | 6/1999 |
| JP | 58080494 | | 5/1983 |
| JP | 09032553 | | 2/1997 |
| JP | 2001012244 | | 1/2001 |

* cited by examiner

*Primary Examiner* — John K Ford
(74) *Attorney, Agent, or Firm* — Patrick M. Sheldrake; Michael G. Harms

(57) ABSTRACT

Apparatus for supporting a heat exchanger such as a condenser of an air conditioning system on a vehicle, for pivotal movement between an operational position and a position angularly related to the operational position, for such purposes as inspection, cleaning, service and maintenance, the apparatus being configured for holding the heat exchanger in the operational position, and for guiding and controlling movement thereof to the tilted position, and holding the heat exchanger in the tilted position.

9 Claims, 7 Drawing Sheets

APPARATUS FOR TILTING AND SECURING A HEAT EXCHANGER

This divisional application claims priority under 35 U.S.C. §120 from previously U.S. patent application Ser. No. 10/877,379 filed on Jun. 25, 2004 by John T. Rasset that has issued as U.S. Pat. No. 7,370,690 with the same title, the full disclosure of which is hereby incorporated by reference.

TECHNICAL FIELD

This invention relates generally to apparatus for supporting a heat exchanger such as a condenser of an air conditioning system on a vehicle, for pivotal movement between an operational position and a tilted position angularly related to the operational position, for such purposes as inspection, cleaning, service and maintenance, and more particularly, to apparatus configured for holding the heat exchanger in the operational position, and for guiding and controlling movement thereof to the tilted position, and holding the heat exchanger in the tilted position.

BACKGROUND ART

Heat exchangers, such as condensers of air conditioning systems, charge air coolers, and radiators for engines, may require from time to time, inspection, cleaning, maintenance and repair. In particular, for vehicles such as work machines and tractors, cleaning of debris such as dirt and airborne crop material from the heat exchanger may be required during the operation of the work machine or tractor periodically or from time to time. Such heat exchangers, particularly air conditioning system condensers and charge air coolers, are often mounted one adjacent the other for air flow sequentially therethrough. In an application such as on a tractor, it is often desired for ease of manufacturing and other purposes that the air conditioning condenser not be mounted directly to the charge air cooler. There are also space restrictions under the shroud or hood of a tractor where the air conditioning condenser and charge air cooler are to be located, and also restrictions therebelow, which limit the available space for placement of supporting structure for these heat exchangers. The air conditioning condenser is also typically required to be appropriately spaced from the charge air cooler for proper cooling effect. Still further, fluid lines to the air conditioning condenser must be reliable and containable within the space constraints mentioned above.

Heat exchangers for applications such as tractors and other work machines are typically subjected to substantial vibration and jarring, and thus it is desirable that support structure therefor should be capable of holding the heat exchanger in its operational position under such conditions. It is also desirable that the heat exchanger be movable between its operational and cleaning positions without disassembly, unfastening and fastening fasteners, and without use of tools.

Thus, what is sought is apparatus for supporting a heat exchanger which provides at least some of the capabilities and overcomes at least some of the shortcomings and limitations set forth above.

SUMMARY OF THE INVENTION

What is disclosed is apparatus for supporting a heat exchanger for pivotal movement on a vehicle which provides many of the capabilities and overcomes many of the shortcomings and limitations set forth above.

According to one aspect of the invention, the heat exchanger has a first air flow surface facing in a first direction, a second air flow surface facing in a second direction opposite the first direction, opposite sides extending between the first and second surfaces, and an end portion extending between the sides. The end portion is preferably mounted to the vehicle for pivotal movement of the heat exchanger in the first and second directions about a side-to-side extending pivotal axis. The apparatus preferably includes at least one elongate arm which securely holds the heat exchanger in a first pivotal position which is an operational position, the arm being graspable by a person and moved for controllably pivoting the heat exchanger from the first pivotal position to a second pivotal position or cleaning position, angularly related to the first pivotal position. Each arm has a first end and a second end opposite the first end, the first end being pivotally connected to the vehicle adjacent to one of the sides of the heat exchanger for pivotal movement of the arm relative to the vehicle generally in the first and second directions. An element such as a pin, tab or projection is disposed on the heat exchanger and is cooperatively engageable with an element on the arm, which can be for instance, a slot in and extending along the arm, such that when the heat exchanger is in the first pivotal or operational position, the pin or other element will be located adjacent to the first end of the arm and the arm will be positioned and oriented generally beside the heat exchanger for holding or locking the heat exchanger in that position. The arm is manually pivotable from the position beside the heat exchanger generally in the first direction to cause the pin or other element to controllably move along the arm to a position adjacent to the second end of the arm to simultaneously pivot the heat exchanger in the first direction to the second pivotal position or cleaning position tilted at an angle relative to the first pivotal position. The arm can be utilized for fully or partially supporting the heat exchanger in the second pivotal position. The arm can then be pivoted in the second direction to cause the element to move along the arm back to the position adjacent to the first end of the arm to simultaneously pivot the heat exchanger in the second direction to the first pivotal position. The arm and other structure on the vehicle additionally can include elements cooperatively engageable when the arm is in the position beside the heat exchanger, for holding it in that position and for limiting or reducing vibration. Such cooperatively engageable elements for holding the arm can include, for instance, a spring clip or the like. A handle element can also be located on the second end of the arm and adapted or configured to be grasped for facilitating pivoting the arm between the first and second positions.

According to another preferred aspect of the invention, the heat exchanger has a center of gravity disposed between the air flow surfaces thereof, and the heat exchanger is mounted to the vehicle for pivotal movement about a side-to-side extending axis located or offset a predetermined distance from the center of gravity in the first direction, such that when the heat exchanger is in the first pivotal position, gravity or its own weight will create a moment about the pivot joint which will act to urge it to pivot in the second direction, to help hold or retain the heat exchanger in the first position and oppose forces in the opposite direction resulting from jarring and the like that may urge the heat exchanger in the opposite direction. The arm also preferably includes an element positioned to abut the heat exchanger when in the first position and the arm is positioned beside the heat exchanger, for further holding it in that position, and for damping and limiting vibration of the heat exchanger and the arm. Such element can include a resilient pad contacting the heat exchanger for cushioning and vibration reduction. Such element can also be positioned and oriented for applying a force against the heat exchanger in the first direction when the arm is pivoted in that direction from its position beside the heat exchanger, for initiating the pivotal movement of the heat exchanger toward the second pivotal position. Still further, the arm is preferably of sufficient length such that the tilt angle of the second pivotal position relative to the first pivotal position can be between about 20° and about 60°, to provide sufficient space for inspecting and accessing aspects of the heat exchanger for cleaning, servicing, maintenance and other purposes.

The arm is preferably pivotally connected to an upper end of an upwardly extending support member mounted to the vehicle, such that the heat exchanger will be in an upstanding orientation beside the support member when in the first pivotal position. The support structure includes another upwardly extending support member beside the opposite side of the heat exchanger, and another of the arms pivotally connected to that support member, for supporting the heat exchanger for pivotal movement in the above-described manner. The support structure can also be configured for supporting and mounting adjacent elements such as one or more other heat exchangers which can include, for instance, a charge air cooler, an engine coolant radiator, and/or a hydraulic system cooler, in an assembly. As a result, the heat exchangers can be positioned as desired or required in spaced apart relation, and the pivotability of the first heat exchanger allows access to both the adjacent surface of the pivoted heat exchanger, and also the next one of the heat exchangers.

DETAILED DESCRIPTION OF THE INVENTION

Figure 1:
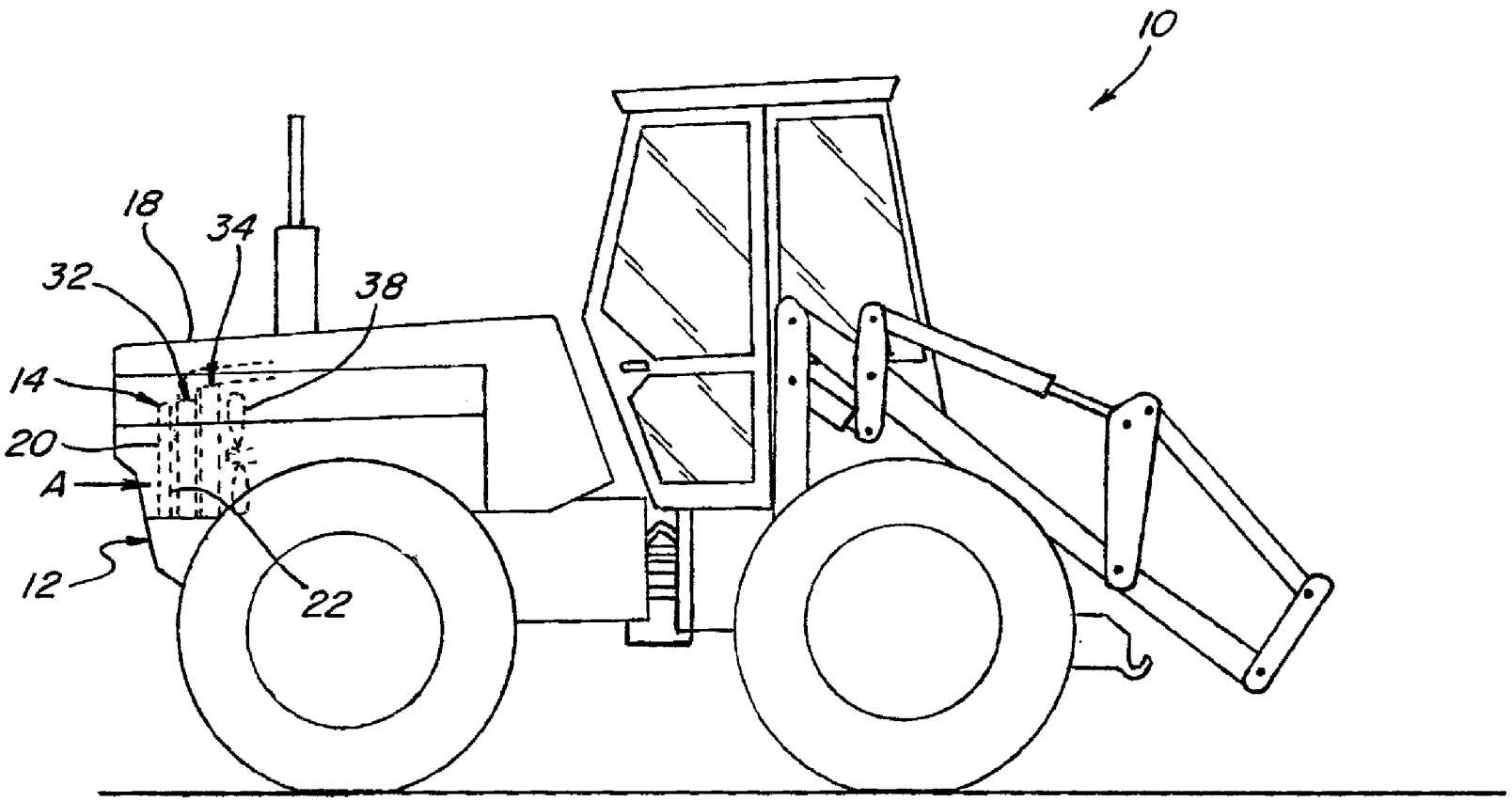
FIG. 1 is a simplified side view of a tractor including apparatus supporting a heat exchanger according to the invention on one end of the tractor.
Figure 2:
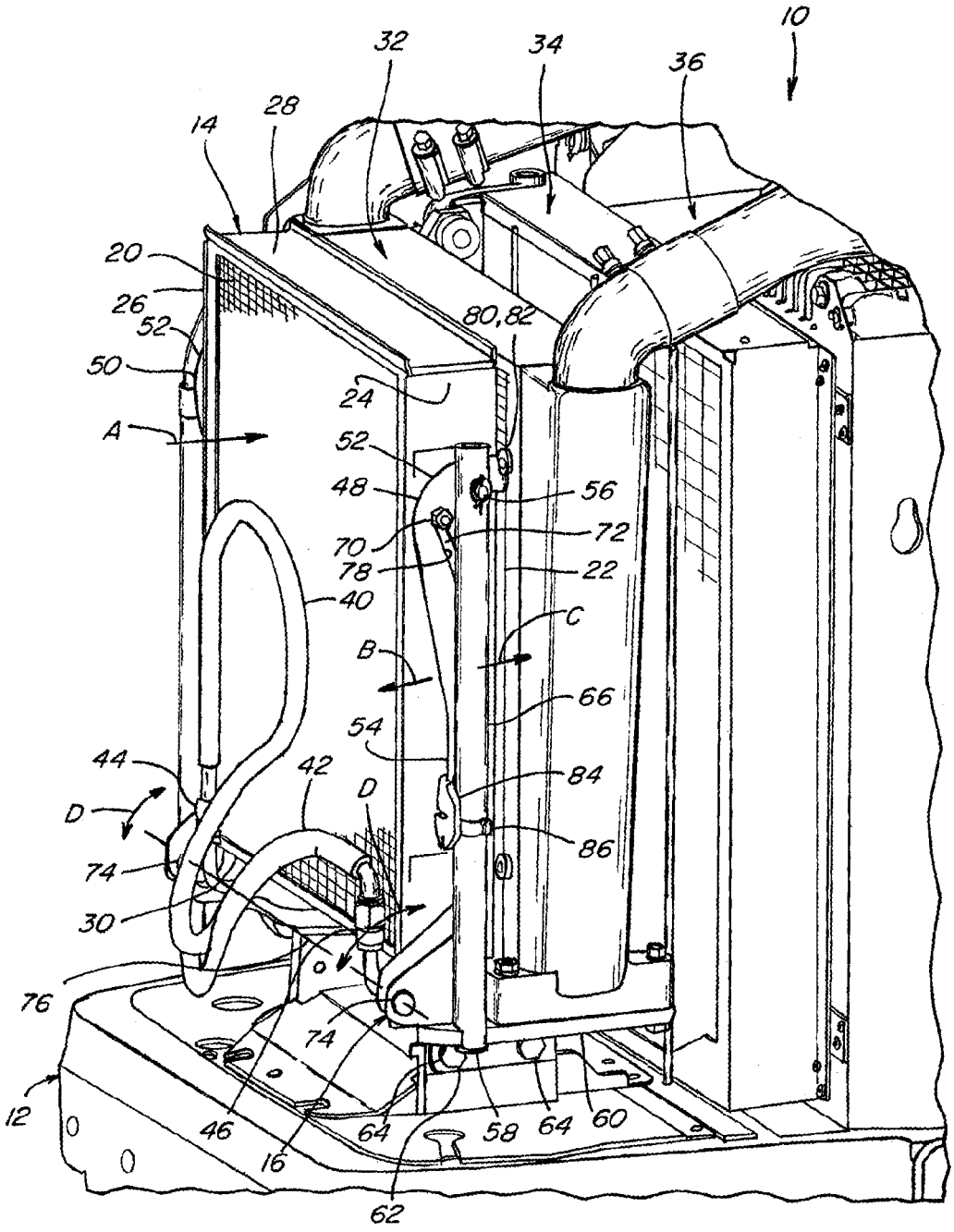
FIG. 2 is a fragmentary perspective view of the end of the tractor, with a hood removed to show the heat exchanger supported by the apparatus of the invention in a first pivotal position.

Referring to FIGS. 1 and 2, a vehicle, which is a bi-directional tractor 10, is shown, including an end 12 having a heat exchanger 14 mounted and supported for pivotal movement by apparatus 16 (FIG. 2) constructed and operable according to the teachings of the present invention. Bi-directional tractor 10 is representative of a wide variety of vehicles, particularly work machines, such as tractors for agricultural, construction, and mining purposes, with which the present invention can be used. Heat exchanger 14 is shown mounted on end 12 within a space defined by an outer hood 18 (shown removed in FIG. 2). Heat exchanger 14 is depicted as a conventional condenser of an air conditioning system of tractor 10, and includes a generally planar first air flow surface 20 facing in a first longitudinal direction of tractor 10, and an oppositely facing second air flow surface 22, for the flow of air through heat exchange 14, in the conventional, well known manner. Heat exchanger 14 additionally includes opposite sides 24 and 26, and upper and lower portions 28 and 30, all extending between air flow surfaces 20 and 22. Another heat exchanger, which is a charge air cooler 32 for the engine intake, is disposed adjacent to second air flow surface 22 of heat exchanger 14 and includes opposite air flow surfaces, also in the conventional, well known manner. Another heat exchanger, which is an oil cooler 34, is disposed adjacent charge air cooler 32, opposite heat exchanger 14. Still another radiator 36 is mounted beside cooler 34.

Tractor 10 includes a cooling fan 38 beneath hood 18 which is rotatable in the conventional, well known manner, for drawing a flow of air through heat exchanger 14 from first air flow surface 20 to second air flow surface 22, as denoted by arrow A, and through charge air cooler 32, cooler 34 and radiator 36, for removing heat therefrom, also in the conventional, well known manner.

As a result of heat exchanger 14 being first in line in air flow A, it will have a tendency to be the first of the heat exchangers to encounter and become clogged with airborne debris, such as dust, crop material, insects, and the like. As is well known, buildup of debris, such as dust and the like, on the surfaces of a heat exchanger such as heat exchanger 14, and clogging of passages through the heat exchanger, will decrease the efficiency and effectiveness thereof.

Additionally, clogging will result in a decrease in air flow to heat exchangers downstream in the air flow from the first heat exchanger. Therefore, it is desirable, and often required, to clean debris, such as dust and the like, from the first heat exchanger, from time to time, or periodically. To accomplish this, it is known to provide a hinge or pivoting mount for the first heat exchanger, which allows moving it away from the next subsequent heat exchanger, which here is charge air cooler 32, such that air and/or water can be directed through the first heat exchanger from the downstream side relative to the normal air flow therethrough, to dislodge and remove the accumulated debris such as dust and the like. For agricultural tractors, such as bi-directional tractor 10, and other work machines used in dusty environments and environments in which there is a large amount of airborne particulate matter, it may be necessary to clean the heat exchanger several times during a work operation. Thus, it is desirable to have the ability to quickly and easily move the heat exchanger to a cleaning position. Such cleaning may also be required during times of darkness. As a result, it would be advantageous to be able to move the heat exchanger to its clean-out position and back to its operational position without requiring steps such as loosening or removing fasteners and the like, which can become lost, and without requiring use of tools. However, a location of heat exchangers such as heat exchanger on an end 12 of the work machine such as tractor 10, subjects the heat exchanger to substantial vibration and jarring, such that means must be provided for securely retaining the heat exchanger in its operating position when subject to such extreme vibration and jarring. Still further, for the present application on tractor 10, it is desirable for heat exchanger 14 to comprise a condenser for an air conditioning system of the tractor, and, as such, it is required for pressurized coolant lines, illustrated by lines 40 and 42, to be connected to the heat exchanger, such as by fittings 44 and 46, for pressurized fluid flow to and from heat exchanger 14, without undue stress, strain, twisting, kinking, and other potentially damaging movements when the condenser is moved for cleaning. The ability to move a heat exchanger such as heat exchanger 14 between an operational position and a cleaning position, will also facilitate inspection, maintenance and repair of the heat exchanger.

Figure 3:
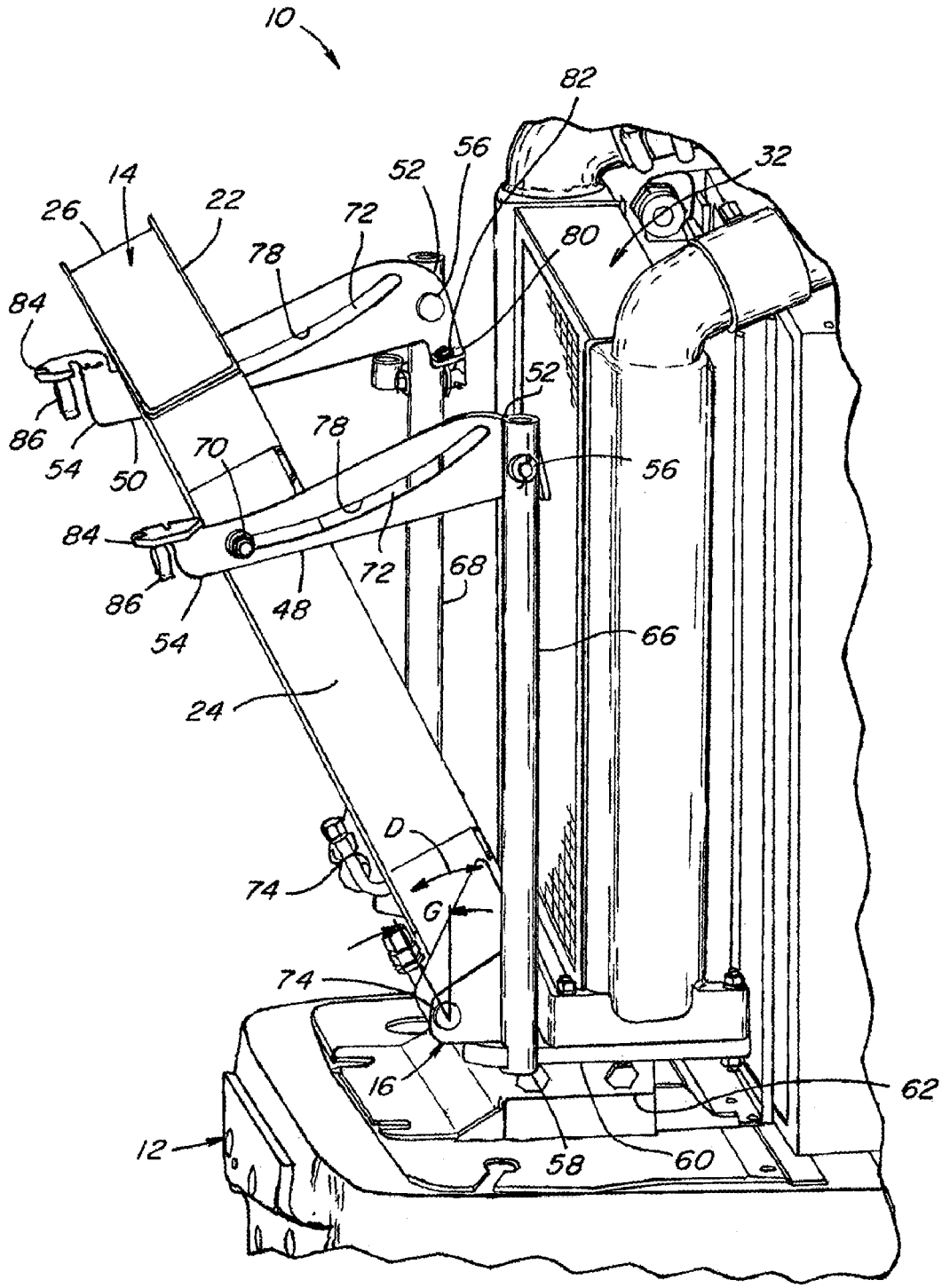
FIG. 3 is another fragmentary perspective view of the end of the tractor, showing the apparatus of the invention supporting the heat exchanger in a second pivotal position angularly related to the first pivotal position.

To provide such capabilities, apparatus 16 is adapted and configured for supporting and holding heat exchanger 14 in a first pivotal position or operating position, which in the present application is the upstanding position shown in FIGS. 1 and 2, and allowing and facilitating manually pivoting heat exchanger 14 in a first direction, opposite air flow direction A, to a second pivotal position, which is a service or clean-out position (FIG. 3), and holding heat exchanger 14 in that position, until manually returned to the operational position, as will be explained.

Referring also to FIGS. 2A, 3, 4, 5 and 6, apparatus 16 includes a pair of arms 48 and 50 which pivotally support and hold heat exchanger 14 in the first and second pivotal positions, and support and guide movement of the heat exchanger between those positions. Each arm 48 and 50 is an elongate member having a first end 52 and an opposite second end 54. First end 52 of each arm 48 and 50 is pivotally supported on vehicle 10 by a pivot joint 56 for pivotal movement of the arm generally in a first direction B, and an opposite second direction C. Apparatus 16 also preferably includes a support structure 58 including a lower support member 60 which includes angle brackets 62 which are mountable to end 12 of tractor 10, using suitable fasteners, such as bolts 64. Support structure 58 is a generally U-shape structure, which can be a weldment, bolted assembly, or the like, and additionally includes a pair of elongate, upstanding upper support members 66 and 68 of tubular steel or the like adjacent to opposite sides 24 and 26 of heat exchanger 14, respectively. In the preferred embodiment, first ends 52 of arms 48 and 50 are pivotally connected by pivot joints 56 to upper ends of upper support members 66 and 68, as shown.

Each side 24 and 26 of heat exchanger 14 includes an element 70 cooperatively engageable with an element 72 on the corresponding arm 48 and 50 for movement therealong between first and second ends 52 and 54 of the arm, such that when heat exchanger 14 is in the first pivotal position, the element 70 will be located adjacent first end 52 of the arm 48 or 50, and the arm 48 or 50 will be positioned generally beside side 24 or 26 of heat exchanger 14, so as to hold or retain heat exchanger 14 in the first pivotal position. Additionally, elements 70 and 72 are relatively movable such that arm 48 or 50 can be grasped by a person and manually pivoted from the position beside heat exchanger 14 in first direction B to apply a force, denoted by arrow F in FIG. 4, to cause element 70 to move along element 72 and along arm 48 or 50 to a position adjacent second end 54 of the arm, such that heat exchanger 14 will be simultaneously pivoted in first direction B to the second pivotal position. Here, element 70 is depicted as a pin, bolt or other sideward projection from heat exchanger 14, and element 72 is depicted as a slot in arm 48 and 50, but it should be understood that other cooperatively and slidably engageable elements could be used, such as a bracket or clip on the side of the heat exchanger which partially encircles or captures and slides along the arm. As another alternative, slots could be provided along the longitudinally extending outer edges of the arms in which a bracket on heat exchanger 14 could slide between the opposite ends of the arms.

Figure 2A:
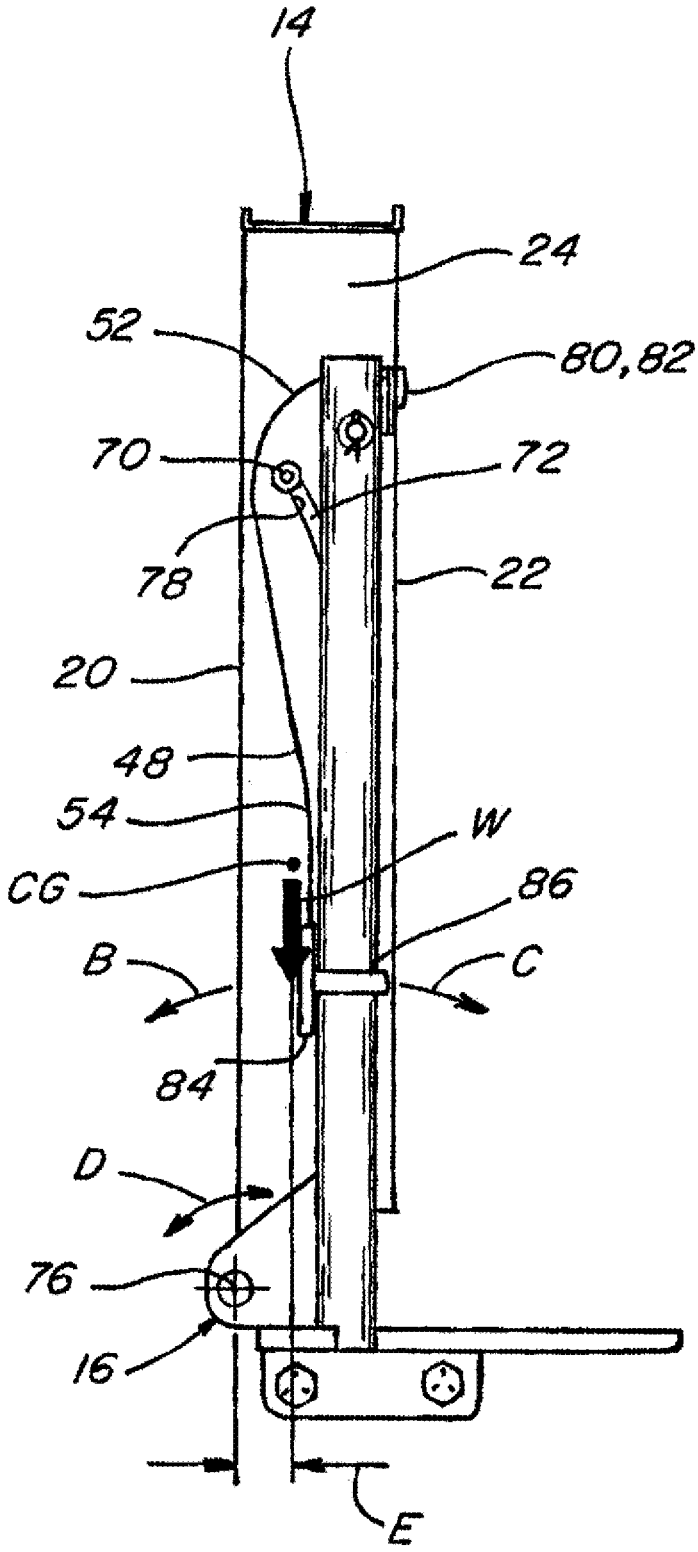
FIG. 2A is a side view of the heat exchanger and apparatus of the invention.

Referring more particularly to FIG. 2A, heat exchanger 14 has a center of gravity which is generally disposed about equidistant between first and second air flow surfaces 20 and 22, and generally about equidistant between sides 24 and 26, as denoted by point CG. Heat exchanger 14 is preferably pivotally mounted on end 12 of tractor 10 by pivotal connection to support structure 58 at a pair of pivot joints 74, for pivotal movement about a side-to-side extending pivotal axis 76, as denoted by arrow D. Pivotal axis 76 is preferably located or offset a predetermined distance, denoted as distance E, which can be, for instance, 2 to 6 inches, in first direction B from point CG, such that when heat exchanger 14 is at or near the first pivotal position or operating position as shown, downwardly acting gravity or weight, denoted by arrow W, will urge heat exchanger 14 in the second direction C about pivot joints 74. That is, when heat exchanger 14 is in or close to the upstanding first pivotal position, its weight W will create a moment about pivot axis 76 that will urge heat exchanger 14 to rotate in the clockwise direction about pivotal axis 76. Additionally, the slots of elements 72 of arms 48 and 50 preferably extend curvingly away from first end 52 of the arms generally in second direction C when the arms are in the position beside heat exchanger 14 so as to effectively capture and prevent the pins or other elements 70 from moving in the first direction B, such that arms 48 and 50 effectively lock or hold heat exchanger 14 in the upstanding first pivotal position.

Figure 4:
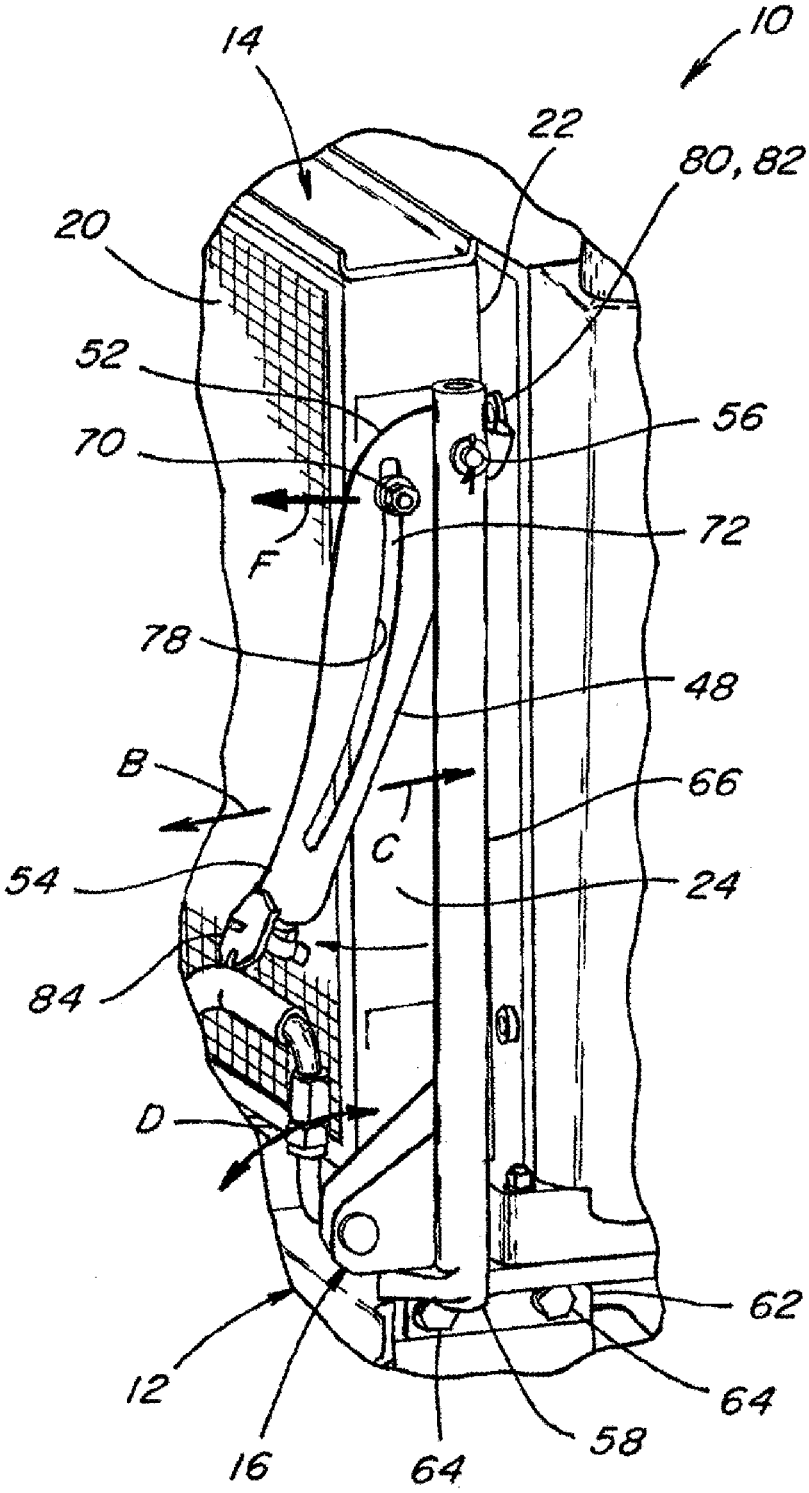
FIG. 4 is another fragmentary perspective view of the end of the tractor and the heat exchanger and apparatus of the invention, showing an arm of the apparatus in a partially pivoted position for initiating pivotal movement of the heat exchanger.
Figure 5:
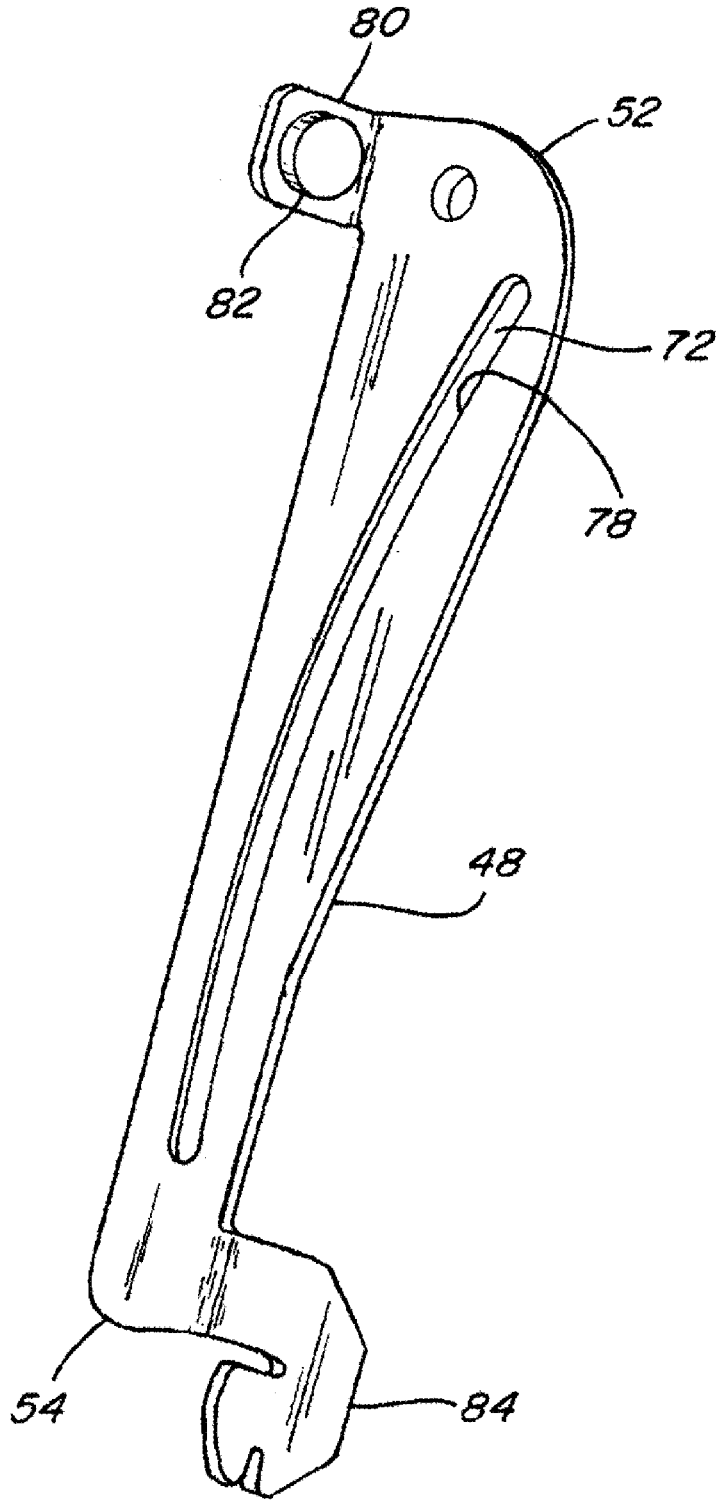
FIG. 5 is a perspective view of an arm of the apparatus.
Figure 6:
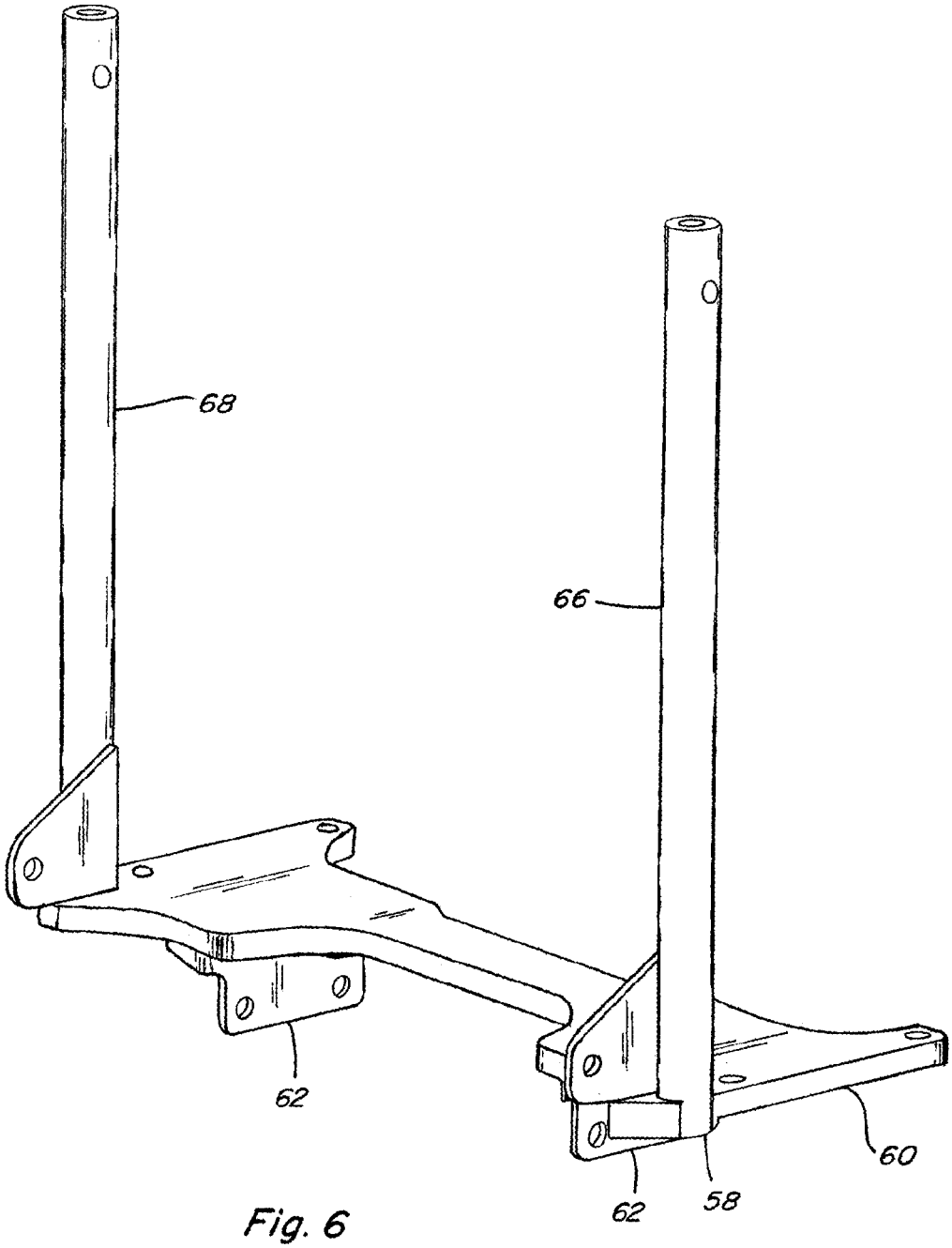
FIG. 6 is a perspective view of support structure of the apparatus.

As still an additional feature for holding heat exchanger 14 in the upstanding first pivotal position, first end 52 of each arm 48 and 50 includes an element 80 which can be, for instance, a tab, ear or other projection, which is positioned adjacent and edge of second air flow surface 22 of heat exchanger 14 when in the upstanding first pivotal position and arms 48 and 50 are in the positions beside the heat exchanger, elements 80 preferably including resilient pads 82 which face and abut surface 22 or an edge of that surface, so as to prevent further movement of heat exchanger 14 in second direction C for maintaining a desired spaced relationship between surface 22 and an opposing surface of adjacent charge air cooler 32. Additionally, elements 80 and resilient pads 82 can be positioned to exert a resilient biasing force against heat exchanger 14 in first direction B, to maintain the pin of element 70 in engagement with edge 78 of the slot of element 72, to reduce or limit any vibration or rattling between those components. As still another feature of elements 80 and pads 82, when arms 48 and 50 are pivoted in direction B for pivoting heat exchanger 14 away from the upstanding first pivotal position, lower edges of resilient pads 82 are pressed against heat exchanger 14 for initiating the pivotal movement thereof in direction B, as best illustrated in FIG. 4. Continued pivotal movement of arms 48 and 50 in direction B will cause pins of element 70 to slide or move along the slots of elements 72 to controllably guide pivotal movement of heat exchanger 14 in direction B toward the second pivotal position shown in FIG. 3. At that position, the pins of elements 70 will be at the terminal end of the slots of elements 72, such that arms 48 and 50 will hold and retain heat exchanger 14 in that position. Here, it should be noted that the second pivotal position is preferably a position tilted at an acute angle relative to the upstanding first pivotal position, which tilted position can be for instance within a range of about 20° to about 60° relative to the first pivotal position, as denoted by angle G in FIG. 3. An angle within this range has been found to provide an adequate space between heat exchanger 14 and an adjacent heat exchanger such as charge air cooler 32 for reaching second air flow surface 22 for cleaning and other purposes.

As an additional feature, second ends 54 of arms 48 and 50 preferably include handles 84 projecting sidewardly therefrom, which can be grasped by a person for pulling arms 48 and 50 for pivoting them about pivot joints 56, for pivoting heat exchanger 14 about axis 76 between the first and second pivotal positions. And, as still another feature, second ends 54 include elements cooperatively engageable with elements on tractor 10 for holding ends 54 when arms 48 and 50 are in position beside heat exchanger 14, for reducing or limiting vibration. Such elements can include, for instance, resilient spring clips 86 cooperatively engageable with upstanding support members 66 and 68, as shown in FIGS. 2 and 2A.

As still an additional feature, lower support member 60 of support structure 58 of apparatus 16 extends in second direction C sufficiently so as to provide a platform or base on which one or more adjacent heat exchangers, such as charge air cooler 32, can be mounted to form a heat exchanger assembly. In this way, the spacing between heat exchanger 14 and charge air cooler 32 can be closely controlled. Also, jointly mounting heat exchanger 14 and charge air cooler 32 facilitates assembly of tractor 10.

Referring again to FIG. 2, to prevent stress, strain, twisting, kinking, and other potentially damaging movements to coolant lines 40 and 42 when heat exchanger 14 is pivoted between its first and second pivotal positions, lines 40 and 42 are preferably each formed into partial coils, at least one of which is located adjacent to the first air flow surface 20.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

What is claimed is:

1. In a vehicle including a heat exchanger having a first surface facing in a first direction, a second surface facing in a second direction opposite the first direction, opposite sides extending between the first and second surfaces, and an end portion extending between the sides mounted to the vehicle for pivotal movement of the heat exchanger about a side-to-side extending pivotal axis, an improvement comprising:

an arm having a first end and a second end opposite the first end, the first end being pivotally connected to the vehicle adjacent to one of the sides of the heat exchanger for pivotal movement of the arm relative to the vehicle in the first and second directions, and an element on the heat exchanger cooperatively engaged with a guide on the arm for movement therealong between the first and second ends thereof such that when the heat exchanger is in a first pivotal position, the element will be located adjacent to the first end of the arm and the arm will be positioned generally beside the heat exchanger so as to hold the heat exchanger in the first pivotal position, the guide extending in the second direction away from the first end of the arm and configured to maintain the element adjacent the first end of the arm when the arm is beside the heat exchanger in the first pivotal position;

the element on the heat exchanger comprising a pin which is cooperatively received in the guide, which is formed as a slot in the arm, the slot in the arm having a shape which curves in the second direction away from the first end of the arm so as to hold the pin in the slot adjacent the first end of the arm when the arm is beside the heat exchanger in the first pivotal position; and and wherein the arm is pivotable from the position beside the heat exchanger in the first direction to apply a force moving the element along the arm to a position adjacent to the second end of the arm to pivot the heat exchanger in the first direction to a second pivotal position supported by the arm at an angle relative to the first pivotal position.

2. In the vehicle of claim 1, the improvement further comprising a handle element on the second end of the elongate arm adapted to be grasped for pivoting the arm.

3. In the vehicle of claim 1, the heat exchanger having a center of gravity disposed between the first and second surfaces thereof, and the improvement further comprising the end portion of the heat exchanger being mounted to the vehicle such that the side-to-side extending pivotal axis is located a predetermined distance from the center of gravity in the first direction such that when in the first pivotal position, the heat exchanger will be urged by gravity toward the second direction.

4. In the vehicle of claim 1, the improvement further comprising the second end of the arm including an element cooperatively engageable with an element on the vehicle for holding the arm in the position beside the heat exchanger and limiting vibration of the arm during operation of the vehicle.

5. In the vehicle of claim 1, the heat exchanger comprising an air conditioning condenser, and the improvement further comprising at least one air conditioning fluid line which connects to the condenser adjacent to the end portion mounted to the vehicle for pivotal movement, the fluid line being formed into at least a partial loop located adjacent to and generally parallel to the first surface.

6. In the vehicle of claim 1, the improvement further comprising the angle relative to the first pivotal position being an acute angle within a range of from about 20° to about 60°.

7. In the vehicle of claim 1, the improvement further comprising a U-shape support structure including a lower support member which mounts to the vehicle and includes pivots mounting the end portion of the heat exchanger to the vehicle, the support structure further including spaced apart upwardly extending support members disposed adjacent the opposite sides of the heat exchanger when in the first pivotal position, respectively, the first end of the elongate arm being pivotally connected to an upper end of one of the support members.

8. In the vehicle of claim 7, the improvement further comprising elements on the upwardly extending support member and the arm cooperatively engageable for releasably holding the arm in the position generally beside the heat exchanger and for limiting vibration of the arm resulting from operation of the vehicle.

9. In a vehicle including a heat exchanger having a first surface facing in a first direction, a second surface facing in a second direction opposite the first direction, opposite sides extending between the first and second surfaces, and an end portion extending between the sides mounted to the vehicle for pivotal movement of the heat exchanger about a side-to-side extending pivotal axis, an improvement comprising:

an arm having a first end and a second end opposite the first end, the first end being pivotally connected to the vehicle adjacent to one of the sides of the heat exchanger for pivotal movement of the arm relative to the vehicle in the first and second directions, and an element on the heat exchanger cooperatively engaged with the arm for movement therealong between the first and second ends thereof such that when the heat exchanger is in a first pivotal position, the element will be located adjacent to the first end of the arm and the arm will be positioned generally beside the heat exchanger so as to hold the heat exchanger in the first pivotal position, the element movable along the arm to a position adjacent to the second end of the arm to simultaneously pivot the heat exchanger in the first direction to a second pivotal position supported by the arm at an angle relative to the first pivotal position; and a resiliently yieldable element on the first end of the arm positioned to abut the heat exchanger for holding the heat exchanger in the first pivotal position when the arm is positioned beside the heat exchanger, and which will apply a force against the heat exchanger in the first direction when the arm is pivoted away from the position beside the heat exchanger for initiating the pivoting of the heat exchanger in the first direction from the first pivotal position.

* * * * *